United States Patent [19]

Dean, II

[11] 3,964,113

[45] June 22, 1976

[54] SLEEPING BAG SUSPENSION SYSTEM

[76] Inventor: Leslie Byron Dean, II, 5125 Williams Fork Trail No. 108, Boulder, Colo. 80301

[22] Filed: Jan. 9, 1975

[21] Appl. No.: 539,791

[52] U.S. Cl. ..... 5/121; 5/343

[51] Int. Cl.[2] ..... A45F 3/22; A41G 9/00

[58] Field of Search ..... 5/123, 82, 120, 121, 5/122, 124, 343

[56] References Cited

UNITED STATES PATENTS

| | | | |
|---|---|---|---|
| 202,814 | 4/1878 | Hanks | 5/120 |
| 866,322 | 9/1907 | Barratt | 5/123 |
| 1,081,481 | 12/1913 | Avery et al. | 5/121 |
| 1,401,846 | 12/1921 | Wiles | 5/121 |
| 2,375,792 | 5/1945 | Kearney | 5/121 |
| 3,675,256 | 7/1972 | Tallarico | 5/120 |

*Primary Examiner*—Robert L. Wolfe
*Assistant Examiner*—Andrew M. Calvert
*Attorney, Agent, or Firm*—Cahill, Sutton & Thomas

[57] ABSTRACT

A plurality of internal transversely oriented webbings are disposed within a sleeping bag intermediate the occupant and the bottom insulating sleeping bag panel. A suspension system is attached to the lateral extremities of the webbings to support the sleeping bag without crushing the insulating material within the bottom panel.

5 Claims, 5 Drawing Figures

SLEEPING BAG SUSPENSION SYSTEM

The present invention relates to body support apparatus for outdoorsmen and, more particularly, to a means for maintaining the full thermal insulation capability of a sleeping bag.

State of the art sleeping bags are constructed on the premise that a sleeping bag must provide light weight thermal insulation for an occupant and be compactable to a small volume. However, these goals are somewhat mutually exclusive and must, as a practical matter, be modified within certain boundaries of weight and volume. As a result, the state of the art sleeping bags are constructed of very light weight crushable thermal insulating material, such as goose down or man-made fibers. These materials are held in place within each of a plurality of adjacent compartments which, in combination, form the sleeping bag. The cloth forming the sleeping bag envelope is generally of fine mesh light weight nylon.

The volume of the sleeping bag, when it is not in use, must be minimized for optimum utility by the outdoorsman or backpacker. Hence, the crushability of the insulating material, as well as the crushability of the cloth envelope should be maximized to permit the sleeping bag to be rolled or folded into the smallest possible volume.

The feature of crushability which makes the presently available sleeping bags compact for storage purposes becomes a disadvantage when the sleeping bag is occupied in that the weight of the outdoorsman or backpacker will tend to compress the insulating material and hence reduce the insulation between the occupant and ground. The reduced insulation will permit heat dissipation to the ground. Obvious solutions to this problem include the use of a non-crushable pad but such a pad is not compactly storable. Or, a hammock may be used to support the sleeping bag above the 11 Again, the insulating material intermediate the sleeping bag occupant and the hammock would become crushed and reduce its insulating capability, thus permitting heat dissipation to the ambient air.

It is therefore a primary object of the present invention to provide apparatus for supporting a sleeping bag, which apparatus does not impair the thermal insulation qualities of the sleeping bag.

Another object of the present invention is to provide apparatus for suspending a sleeping bag above ground while retaining the full thermal insulation qualities of the sleeping bag.

Still another object of the present invention is to provide an above ground support for sleeping bags which is compact and light weight.

Yet another object of the present invention is to provide an above ground support system integral with a sleeping bag.

These and other objects of the present invention will become apparent to those skilled in the art as the description thereof proceeds.

The present invention may be described with greater specificity and clarity with reference to the following drawings, in which.

As discussed above to a limited extent, the insulating qualities of a sleeping bag are dependent upon not only the type of insulation material but also the degree to which the insulation material is crushed or compacted during deployment of the sleeping bag. Sleeping bags are often made of light weight and readily crushable insulating material to allow compacting for transportation and storage. However, such sleeping bags tend to permit heat dissipation to the adjacent supporting surface when in use as the insulating material between the occupant and the supporting surface is compacted and crushed by the occupant's weight. Similarly, heat dissipation to the ambient atmosphere will occur if the sleeping bag is supported by a mesh or cloth hammock.

Figure 1:
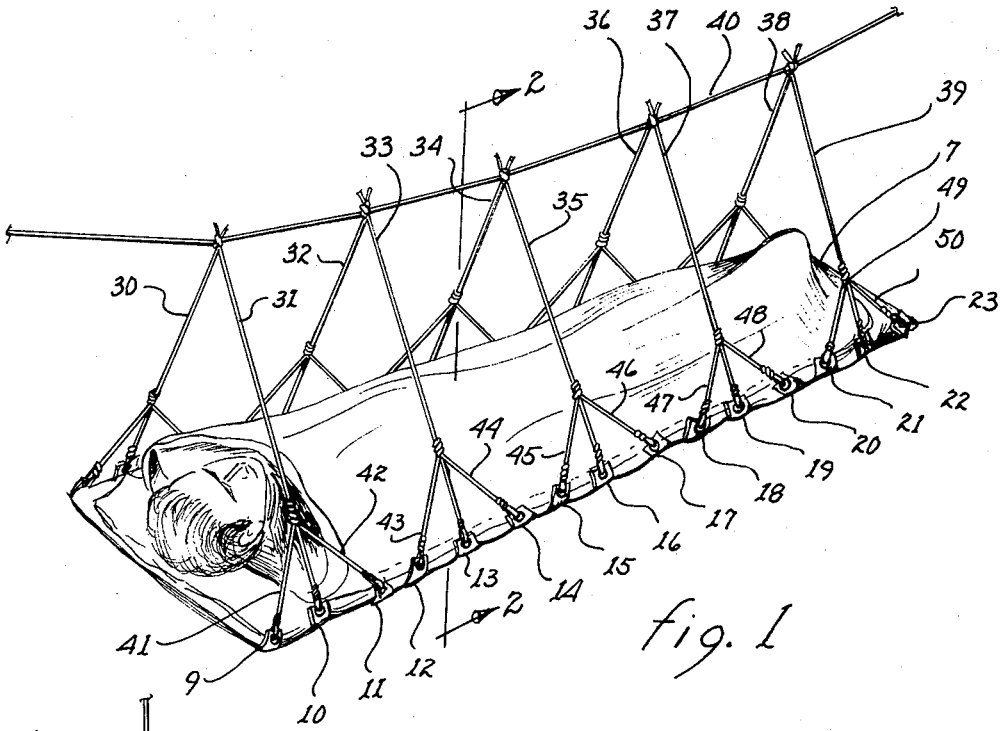
FIG. 1 illustrates a perspective view of the present invention.
Figure 2:
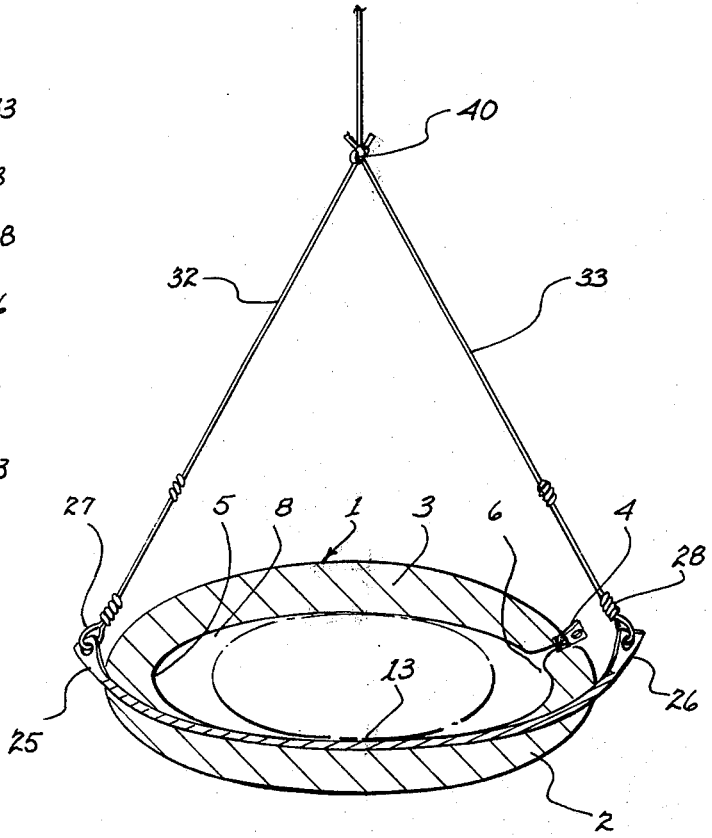
FIG. 2 is a cross-sectional view of the present invention taken along lines 2—2, as shown in FIG. 1.

Referring now to FIGS. 1 and 2, there is shown a construction for a sleeping bag 1 which adequately supports the occupant without the formerly attendant crushing of at least part of the insulating material. The sleeping bag is formed by a bottom insulating panel 2 foldingly attached along side 5 to a top panel 3. The panels are joined to one another along side 6 by a zipper 4 or similar easily openable and closeable mechanisms. The top and bottom panels, 2 and 3, may be permanently joined to one another at the foot end 7, as is conventional. The compartment formed between panels 2 and 3, and identified by numeral 8, defines the enclosure for the occupant.

As pointed out above, the weight of the occupant lodged within compartment 8 tends to crush the insulation material contained within bottom panel 2 when the sleeping bag 1 is placed on the ground, upon a hammock or other supporting surfaces. With the construction taught by the present invention however, the insulating material contained within bottom panel 2 does not contribute to the support structure for the weight of the occupant within compartment 8. Hence, it will not tend to be crushed by the occupant.

To overcome the need for the insulating material within bottom panel 2 to support an occupant, a plurality of transversely oriented lengths of webbing 10 through 23 are disposed in proximity to the inside surface of bottom panel 2. As specifically illustrated in FIG. 2, the ends or tabs 25 and 26 of webbing 13 extend exterior to the sides 5 and 6, respectively, of sleeping bag 1. Tabs 25 and 26 are apertured to receive and engage hook mechanisms 27 and 28. Load bearing lines 32 and 33 interconnect hook mechanisms 27 and 28, respectively, with a supporting line 40. As particularly shown in FIG. 1, additional pairs of load bearing lines 30 and 31, 32 and 33, 34 and 35, 36 and 37, 38 and 39, interconnect, through hook mechanisms, webbings 10, 13, 16, 19 and 22, respectively. Guy lines can also be employed in conjunction with each load bearing line to stabilize and minimize movement of the sleeping bag along its longitudinal axis. In example, guy lines 41 and 42 are secured to and extend from load bearing line 31 to the tabs of webbings 9 and 11, respectively; guy lines 43 and 44 are secured to and extend from load bearing line 33 to the tabs of webbings 12 and 14, respectively; guy lines 45 and 46 are secured to and extend from load bearing line 35 to the tabs of webbings 15 and 17, respectively; guy lines 47 and 48 are secured to and extend from load bearing line 37 to the tabs of webbings 18 and 20, respectively; and, guy lines 49 and 50 are secured to and extend from load bearing line 39 to the tabs of webbings 21 and 23, respectively. Similar guy lines may be used along side 5, as depicted in FIG. 1.

As illustrated in FIG. 2, the webbing, of which webbing 13 is shown in cross-section, extends through the sleeping bag adjacent the interior surface of bottom panel 2 and beneath the occupant. For convenience sake and to prevent entanglement within the sleeping bag, each strip of webbing can be sewn or otherwise attached to the interior surface of bottom panel 2. With such structure, the webbings directly support the occupant and there will be essentially no compacting or crushing of the bottom panel. As the top panel 3 rests upon the occupant and supports no weight other than its own, it too will not be compacted or crushed. Thereby, the maximum insulation capability of the bottom and top panels can be maintained.

To provide maximum comfort for the occupant of sleeping bag 1, it is preferable to suspend the sleeping bag from supporting line 40 such that the sleeping bag is essentially in a horizontal plane and without having the sleeping bag curve along its longitudinal axis in conformance with the curve of the supporting line. A supporting line, which supports a uniform load across its length will define a catenary curve. Thus, each of the load bearing lines extending upwardly from a horizontal plane are adjusted in length such that the points of attachment with supporting line 40 will approximately assume the curvature of a catenary curve and yet permit the longitudinal axis of sleeping bag 1 to lie in a horizontal plane when the sleeping bag is uniformly loaded.

When the sleeping bag is occupied by an outdoorsman, the load may not be uniformly distributed and hence the supporting line 40, while catenary-like, may not be an exact catenary. In such case, the orientation of the sleeping bag surface can be made to be essentially horizontal by a change in the lengths of the load bearing lines. The load bearing lines can be configured to support the average outdoorsman in a horizontal orientation. Imperfect horizontal orientation of the sleeping bag for outdoorsmen who have a weight distribution meaningfully different from the norm should not seriously detract from the comfort of such an outdoorsman. To fine tune the apparatus to an outdoorsman's particular preference or to accommodate different ranges of load distributions, the load bearing lines can easily be made adjustable in length.

Figure 3:
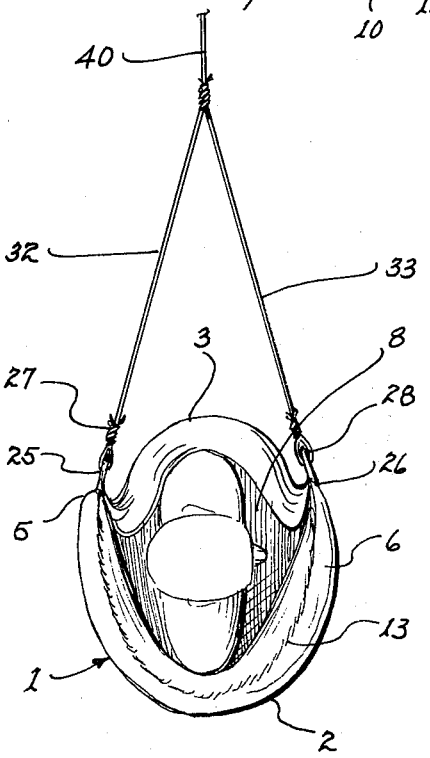
FIG. 3 illustrates an end view of the present invention.

The strips of webbing, if of woven material or other easily bendable material, will permit sides 5 and 6 of the sleeping bag to come toward one another as a result of the occupant's weight bearing upon the center parts of the webbing. Such repositioning of the sides is dramatically illustrated in FIG. 3 wherein the occupant is shown lying on his side. The drawing is also intended to illustrate that the generally horizontal alignment of the sleeping bag 1 is not affected whether the occupant lies on his stomach, his back or either side.

Because of the lateral forces imposed by the sides of the sleeping bag upon the occupant, some persons may develop a sense of claustrophobia or physiological discomfort. To accommodate such persons without departing from the teachings of the present invention, the webbings may be formed of resilient or spring-like material to permit slight bending as illustrated in FIG. 2 but not bending to the extent shown in FIG. 3. These resilient webbings, if permanently attached to bottom panel 2, will necessarily limit the manner in which the sleeping bag 1 is collapsed and folded for transportation and storage. However, they would not preclude normal rolling up of the sleeping bag into a cylindrically shaped configuration. The storage problem can be alleviated if the resilient webbings are removably inserted within laterally oriented envelopes extending across the inside of bottom panel 2. Thereby, the sleeping bag 1, after removal of the resilient webbings, can be collapsed and folded as before and the resilient members can be bundled together for transportation and storage.

Although the above description of the webbings implies strips of transversely oriented material, it is to be understood that the term webbing is used in a broad sense. That is, "webbing means" for the purposes of describing the present invention and interpretation of the appended claims, also contemplates the use of a load supporting sheet adjacent the inner surface of the bottom panel 2 and attachable to load bearing tabs extending through sides 5 and 6; or, a load bearing sheet having tabs insertable through apertures along sides 5 and 6 for attachment to the suspension system. Alternatively, the term contemplates the use of a load bearing sheet formed as an integral part of the inner surface of bottom panel 2 and connectable through tabs or similar means to the suspension system.

It therefore becomes clear that the above described suspension system affords horizontal support for the occupant of the sleeping bag without deleteriously effecting the insulation quality of either the top or bottom panels. The various lines forming the suspension system are readily disconnectable and collapsible to a minimum volume so as to minimize the penalty for the comfort obtained. Moreover, if the occupant feels uncomfortable due to the effect of the lateral forces imposed by the suspension system, the effect can be obviated by employing either attached or removably attached resilient webbings to maintain separation between the sides of the sleeping bag.

During inclement weather conditions, a tarpaulin or similar water repellent cover can be folded over supporting line 40 to drape downwardly over the load bearing lines. Such a cover will protect the occupant against wind, rain and snow. As such a cover can be of very light weight foldable material, its utility, particularly in mountainous country or in cold climates, would justify the increased weight and storage volume.

Figure 5:
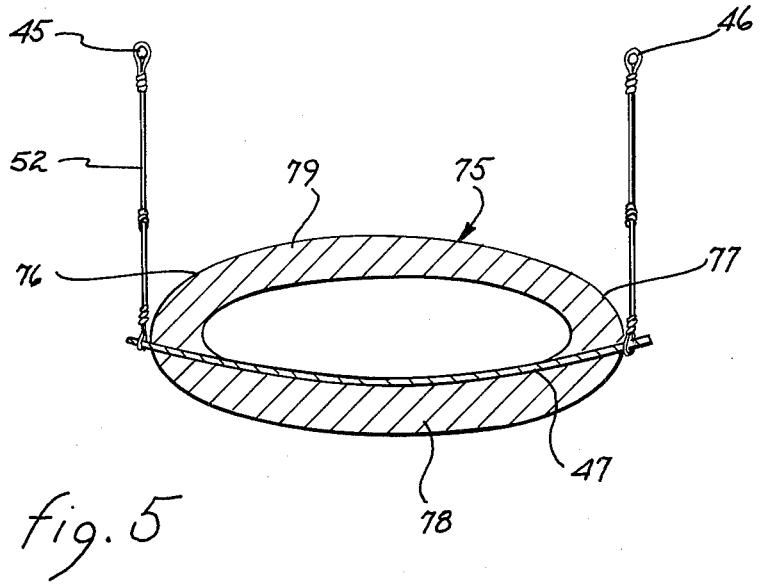
FIG. 5 illustrates an end view of the variant shown in FIG. 4.

The triangular orientation of the paired load bearing lines and the supporting line shown in FIG. 1 may present something of an obstacle during ingress and egress. Any resulting and irritating line entanglement will be obviated by the variant suspension structure shown in FIGS. 4 and 5 at only a slight weight and volume penalty.

Figure 4:
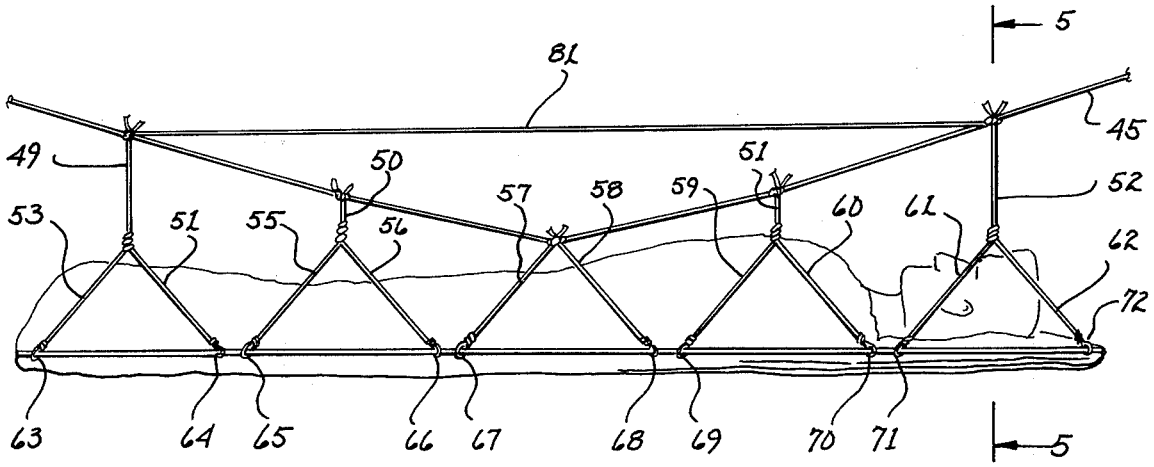
FIG. 4 illustrates a variant of the present invention.

Sleeping bag 75 is formed with a top panel 79 foldingly attached along one side of bottom panel 78; the operable side of the sleeping bag is closed by a zipper or the like. A plurality of webbings 47 extend across the inner side of the bottom panel 78 and may be removably attached thereto. A pair of supporting lines 45 and 46 are spaced apart from one another approximately equivalent to the width of the sleeping bag, or the distance intermediate the tabs of webbings 47. As illustrated in FIG. 4, supporting line 45 supports side 76 of sleeping bag 75 through a plurality of load bearing lines 49, 50, 51 and 52, which lines are attached to pairs of tabs 63 and 64, 65 and 66, 67 and 68, 69 and 70, 71 and 72, through guy lines 53 and 54, 55 and 56, 57 and 58, 59 and 60, 61 and 62, respectively. The length of the load bearing lines and guy lines are preset such that supporting line 45 essentially defines a catenary curve to provide uniform support for the horizontally oriented sleeping bag 75. It may be noted that the center point of supporting line 45 is connected directly to the junction of guy lines 57 and 58 to minimize the height of the supporting line at that point. Side 77 similarly depends from supporting line 46 through a plurality of load bearing lines, guy lines and tabs extending from webbings 47.

With the above described configuration of the variant suspension system, ingress and egress by the occupant can be easily accommodated at the approximate center point of the sleeping bag in proximity to guy lines 57 and 58 with minimum entanglement. Another advantage will also be readily apparent. Because two laterally spaced supporting lines are employed, sides 76 and 77 will impose less lateral force upon the occupant. It therefore may be quite acceptable for most occupants to use readily flexible strips of webbing for webbings 47. The use of such webbings will, of course, permit more compact storage. Should the occupant require or desire a more planar sleeping support, webbings 47 can be constructed of resilient spring-like material, as discussed above.

If a line, such as line 81, extends across each supporting line 45 and 46 from the junction point between load bearing line 49 and load bearing line 52, it can be used to support a cover for protection against inclement weather.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A light weight compactly storable suspension system for supporting a sleeping bag above ground, said sleeping bag having a top panel and a bottom panel, said system comprising:

a. webbing means attached in proximity to the upper surface of the bottom panel of said sleeping bag and oriented transverse to said sleeping bag for supportingly transmitting a load placed upon the bottom panel without compressing the bottom panel, said webbing means being of resiliently flexible material to permit general conformation of the bottom panel to the occupant of said sleeping bag and reduce the width of said sleeping bag during occupancy;

b. a tab disposed at each end of said webbing means for transmitting an external supporting force to each of said webbing means, said tabs being of a length sufficient to extend external to the respective side of said sleeping bag;

c. an overhead line for supporting said sleeping bag;

d. a plurality of pairs of load bearing lines depending from said overhead line at spaced intervals therealong for interconnecting said tabs with said overhead line, each said pair of load bearing lines being of a predetermined length to position said sleeping bag in a generally horizontal plane while said overhead line defines a curve; whereby, said sleeping bag is supported above ground without crushing or compacting the insulating material contained within the bottom panel and the sway of said sleeping bag is minimized during occupancy, ingress and egress.

2. The system as set forth in claim 1 wherein said webbing means is of woven material.

3. The system as set forth in claim 2 wherein said webbing means is adjacent a part of the upper surface of the bottom panel.

4. The system as set forth in claim 1 wherein said webbings are of resilient spring-like material.

5. The system as set forth in claim 4 wherein said webbing means is adjacent a part of the upper surface of the bottom panel.

* * * * *